US005152442A

United States Patent [19]

Gallagher

[11] Patent Number: 5,152,442

[45] Date of Patent: Oct. 6, 1992

[54] CARTRIDGE CLIP CASE

[76] Inventor: Richard N. Gallagher, 2019 W. Quail, Phoenix, Ariz. 85027

[21] Appl. No.: 583,610

[22] Filed: Sep. 17, 1990

[51] Int. Cl.[5] ..... A45F 5/00

[52] U.S. Cl. ..... 224/245; 224/236; 224/239; 224/253; 206/3

[58] Field of Search ..... 224/239, 240, 253, 252, 224/228, 236, 245, 242, 224, 225; 206/3, 814

[56] References Cited

U.S. PATENT DOCUMENTS 3,066,791 12/1962 Bivens ..... 206/3

3,769,733 11/1973 Nelson ..... 224/239

*Primary Examiner*—Linda J. Sholl

*Attorney, Agent, or Firm*—Tod R. Nissle

[57] ABSTRACT

A case for storing and transporting a clip of cartridges which are fired in a gun. A user can remove the clip from the case by inserting his thumb intermediate the clip and the backing of the case and by grasping the clip between his thumb and forefinger.

2 Claims, 2 Drawing Sheets 10
11
12
13
14
15
16
17
18
19
20
21
22
23
24
25
27
30
31
32
40
61
70A
71
A
B
C
D
E
F
2

CARTRIDGE CLIP CASE

This invention relates to a container for storing and transporting clips of bullets which are, when removed from the containers, inserted in a handgun, rifle, or other type of firearm.

More particularly, the invention relates to a clip case which includes a backing and is constructed such that when a clip of bullets is stored in the case and the case is mounted on the belt of a user, the user can readily insert his thumb intermediate the clip and backing to facilitate the grasping and removal from the case of the clip.

In a further respect, the invention relates to a clip case including a backing having a pair of spaced apart slots formed through the backing to slidably receive the belt of a user, the clip case being constructed such that the backing can be formed from a flat, planar piece of material which can be attached to the clip case without requiring the molding or shaping of the backing to a particular contour.

Containers or cases which store and transport clips of cartridges or bullets and which are worn on the hip and belt of a user are well known in the art. Such conventional clip cases often contain two side-by-side pockets or cavities, each of which receives the lower end of an elongate, generally rectangular clip of cartridges. A clip is made from metal and has at least one opening for accepting and dispensing bullets or cartridges. Springs means is often used inside the clip to press together bullets which are stored in the clip and to continuously maintain a bullet positioned at the dispensing opening of the clip. In handguns, a clip is typically utilized by inserting the clip in a hollow channel formed in the handle of the gun.

When a clip is inserted in the pocket or cavity of a conventional clip case, the upper end of the clip extends upwardly and outwardly from the pocket. The back surface of the upper end of the clip abuts against and contacts a backing panel which is against the body of the user and which extends upwardly and outwardly from the pocket of the clip case. Since the back surface of the clip bears against the backing panel of the clip case, it is not possible for the user to insert a finger intermediate the back of the clip and the case backing to grasp the upper end of the clip with his forefinger on the front of the clip and his thumb at the back of the clip. Instead, the user must use his thumb and forefinger to grasp the sides of the clip to pull the clip free from the clip case. When the user grasps the sides of the clip, the hand and arm are in a somewhat awkward position, with the palm of the hand facing the waist of the user and at an angle of about 60° to 90° with respect to the wrist and forearm of the user. Further, since many clip cases hold two clips side by side in close proximity to one another, inserting a finger intermediate two clips and using the hand to pull one of the clips upwardly free from the case is uncomfortable.

Another feature common to many conventional clip cases is that the case includes a panel of material on the back of the case which has a pair of elongate, spaced apart slots formed through the material to slidably receive the belt of the user. The back panel of material is also, in addition to being slotted in the manner described, molded or contoured so the material intermediate the slots projects and is spaced outwardly from the clip case to readily slidably accept a belt which is threaded through the slots and underneath the back panel. Contouring the back panel of material requires additional molding and other processing steps.

Accordingly, it would be highly desirable to provide an improved clip case which would enable a clip to be manually removed by positioning the hand and wrist in a comfortable position and by grasping and pulling the clip from the case.

It would also be highly desirable to provide an improved clip case which did not require the use of a back panel of material which was specially contoured to slidably receive the belt of a user.

These and other, further and more specific objects and advantages of the invention will be apparent to those skilled in the art from the following detailed description thereof, taken in conjunction with the drawings, in which.

Briefly, in accordance with my invention, I provide a case for an elongate clip of cartridges. The clip has an upper end and a lower end. The case includes a housing including an open top, and a cavity; and, a backing surface connected to the housing and outwardly projecting from the top. The cavity is shaped and dimensioned to slidably receive the lower end of the clip through the open top and cavity and is spaced away from the backing surface to permit the thumb of a user to be inserted intermediate the upper end and the backing surface to facilitate grasping of the upper end of the clip when the clip is being manually pulled out of the cavity and free from the case.

Figures 1, 2:
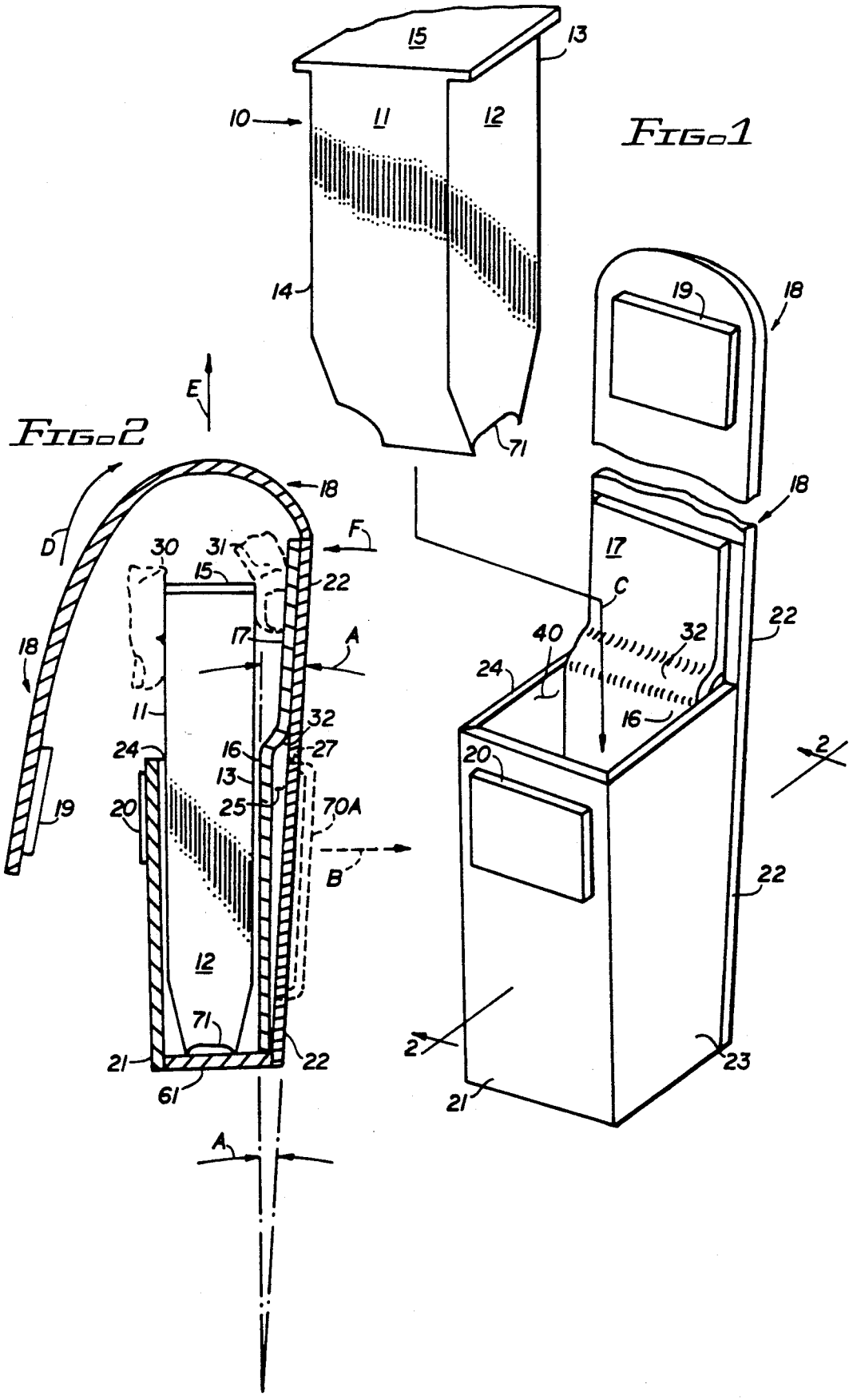
FIG. 1 is a perspective view illustrating a clip case constructed in accordance with the principles of the invention.
FIG. 2 is a side section view illustrating the clip case of FIG. 1 and taken along section lines 2-2 thereof; and, FIG. 3 is a back view of the clip case of FIG. 1 illustrating construction details thereof.
Figure 3:
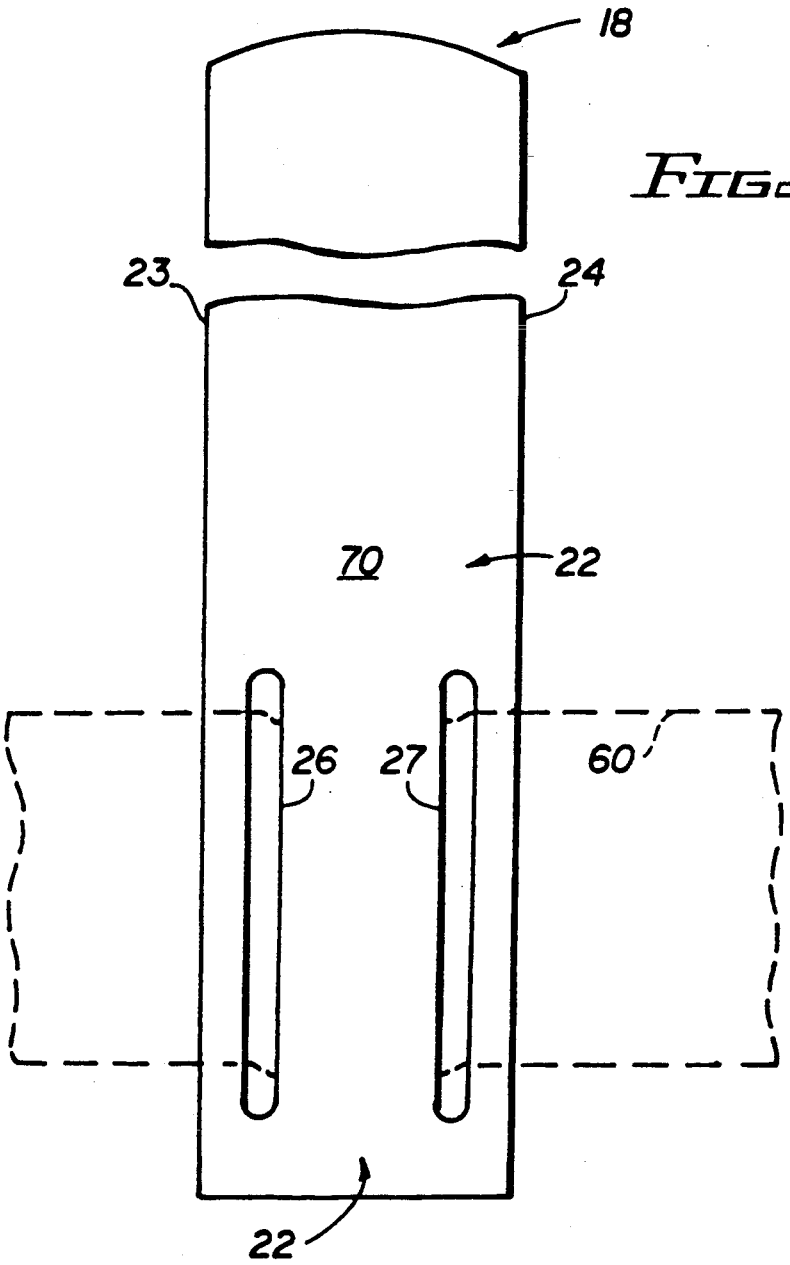

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 3 illustrate a clip case constructed in accordance with the invention and including a housing having a cavity bounded by rectangular panel members 21, 16, 23, 24. The upper ends of members 21, 16, 23, 24 bound and define an open top through which the lower end of a clip 10 is inserted in the cavity bounded by members 21, 16, 23, 24. Clip 10 includes side surfaces 12 and 14, front surface 11 and back surface 13. Cartridges are inserted in and removed from clip 10 through opening 71 at the bottom of clip 10. Other conventional features of clip 10 are, for the sake of simplicity and clarity, omitted from the drawings. For example, not shown is the spring means utilized inside clip 10 to hold bullets in the clip against one another and to maintain a cartridge at the dispensing opening 71 of the clip. The function of clip 10 is to store two or more bullets and, after the clip is inserted in a gun, to sequentially feed the stored bullets or cartridges through opening 71 into the gun to fire the bullets housed in the cartridges.

The lower portion of clip 10 is shown slidably inserted in the clip case in FIG. 2. In FIG. 2, a space is, for the sake of clarity, depicted between front 11 and back 13 surfaces of clip 10 and member panels 21 and 15, respectively. There need not be space between surfaces 11, 13 and members 21 and 16. Surfaces 11, 13 can contact and slide over members 21 and 16 when clip 10 is inserted in or removed from the clip case. In similar fashion, surfaces 12 and 14 can contact and slide over panel members 23 and 24 when clip 10 is inserted in or removed from the clip case.

Bend 32 interconnects panel members 16 and 17. Rectangular planar panel member 17 is attached to the upper portion of member 22 with adhesive, by stitching, or by any other desired means. Panel members 21 and 16 are spaced apart and parallel. Panel members 16 and 22 converge from top to bottom, and the angle between members 16 and 22 is indicated by arrows A. The angle indicated by arrows A is also the angle between surface 13 and member 22. Since member 16 diverges from member 22 from bottom to top, an open space 25 is formed between and bounded by members 16, 23, 22, and 40. Hook patch 20 is affixed to member 21. Loop patch 19 is affixed to strap 18. Strap 18 is connected to and extends outwardly from the upper end of member 22.

As shown in FIG. 3, slots 26 and 27 are formed through flat, rectangular back panel member 22. A belt 60 or other strap worn on the person is threaded through slots 26 and 27 in the manner shown. The portion of belt 60 extending intermediate slots 26 and 27 is, in FIG. 3, beneath member 22 and between members 16 and 22 in space 25. Since the portion of belt 60 extending intermediate slots 16 and 22 is in space 25 and since member 16 is spaced away from member 22, it is not necessary to contour member 22 such that the portion 70 of member 22 intermediate slots 26 and 27 extends outwardly away from the remaining areas of member 22 in the direction of arrow B. If panel 16 were not spaced apart from member 22, but instead contacted, was parallel to, and was immediately against member 22, then the portion 70 of member 22 extending intermediate slots 26 and 27 would be contoured or outwardly raised in the manner illustrated by dashed lines 70A in FIG. 2 so that belt 60 could slidably extend intermediate raised portion 70 and panel member 16.

In use, the clip case of FIGS. 1 to 3 is mounted on the person by threading the user's belt 60 through slots 26 and 27 and beneath portion 70 through space 25 in the manner shown in FIG. 3. The clip case is presently preferably mounted at the waist of the user with member 22 bearing against the upper leg and hip of the user and with panel members 23 and 24 extending outwardly away from the hip and leg of the user. The clip case can be carried on a strap adjacent any other desired portion of the user's body or can be transported separately from the user. Strap 18 is pulled open in the direction of arrow D to the position shown in FIG. 1 and clip 10 is inserted in the clip case in the manner indicated by arrow C in FIG. 1. After clip 10 is inserted in the case of FIG. 1, the lower portion of surfaces 11 to 13 contact members 21, 23, 16 and 24, respectively. Members 21, 16, 23, 24 bound, contact, and house the lower portion of clip 10. The upper portion of clip 10 extends outwardly away from the open top 40 as illustrated in FIG. 2. The angle between surface 13 and member 22 is indicated by arrows A. Since surfaces 11 and 16 are parallel, the angle between surface 11 and member 22 is also indicated by arrows A. The angle between surface 13 and members 17 and 22 is indicated by arrows A. Surface 13 and member 17 converge and become closer together as the distance from the bottom 61 of the clip case decreases.

When strap 18 is opened to the position shown in FIG. 1, the user removes the clip from the case by inserting his thumb 31 intermediate back surface 13 and backing member 17, by placing his forefinger 30 (or his middle finger) on the front surface 11, by squeezing the clip 10 between his forefinger 30 and thumb 31, and by lifting clip 10 free from the case in the direction of arrow E. If the middle finger is positioned on surface 11, the forefinger of the user's hand can be positioned on surface 12. The clip case is, for the sake of the following discussion, assumed to be worn at the hip or front waist of the user. When thumb 31 is inserted between case 10 and backing member 17 in the manner shown in FIG. 2, the palm of the user's hand is normally generally facing downwardly, the knuckles of the hand are generally facing upwardly, and, as the thumb 31 is pushed downwardly intermediate clip 10 and member 17 the space between surface 13 and member 17 decreases to increase the compressive forces acting on thumb 31. Consequently, the convergence of surface 13 and member 17 gives the user, due to the change in the magnitude of compressive forces acting on the thumb, an indication of how far downwardly the thumb 31 has been inserted between surface 13 and member 17. This indication assists the user in positioning his thumb at the desired position along surface 13. Further, the compressive forces generated on the thumb 31 by surface 13 and member 17 assist the user in obtaining a secure grasp of clip 10. The canting of clip 10 with respect to member 17 facilitates the ready removal of clip 10 from the clip case.

Members 16 and 17 and bend 32 presently comprise a single molded substantially rigid hard plastic piece. Members 21, 23, and 24 presently are also formed from hard plastic, while member 22 and flap 18 are formed from leather or from a leather like or pliable material or laminate. The leather or material or laminate used to form flaps 18 and member 22 is pliable to allow the bend of flaps 18 and to facilitate the threading of a strap or belt 60 through slots 26, 27. While member 17 is substantially rigid, it can be flexed a short distance in the direction of arrow F. After the force necessary to flex member 17 is released, member 17 returns to the position shown in FIG. 2 Bend 32 does not readily flex in the direction of arrow F, and provides support for member 17 to restrict the lateral movement of member 17 from the position shown in FIG. 2 in the direction of arrow A or in a direction opposite that of arrow A.

Panel members 21, 23, 24 are glued or otherwise affixed to one another, or, can be molded in unitary form. Member 17 presently is stitched to member 22 but can be affixed to member 22 in any other desirable manner.

Having described my invention in such terms as to enable those skilled in the art to understand and practise it, and having identified the presently preferred embodiments thereof, I claim:

1. A case for an elongate clip of cartridges, said clip having an upper end including an outer planar surface, and a lower end, said case including (a) a housing including (i) a front panel member, (ii) a back panel member, (iii) a unitary substantially rigid member including an inner surface intermediate said front and back panel members and canted inwardly away from said back panel member, and a backing surface connected to said back panel member and canted outwardly away from said inner surface, (iv) an open top, (v) a cavity bounded in part by said front panel member and said inner surface, said backing surface outwardly projecting from said top; and, (b) a flap connected to and outwardly extending from said back panel member to be pulled over and cover said top;

said cavity being shaped and dimensioned to slidably receive said lower end of said clip through said open top such that said lower end slides over said inner surface and over said front panel member when said slip is inserted in said cavity, said upper end extends outwardly from said open top and cavity and is spaced away from said backing surface to permit the thumb of a user to be inserted intermediate and contact said planar surface of said upper end and said backing surface to facilitate grasping of said upper end of said clip when said clip is being manually pulled out of said cavity and free from said case, and said planar surface of said upper end is generally parallel to said inner surface and is canted away from said backing surface.

2. The case of claim 1 wherein (a) a pair of spaced apart slots are formed through said back panel member; and, (b) a space is formed intermediate and bounded by said back panel member and said rigid member such that a strap can be threaded through one of said slots, intermediate said back panel member and said rigid member, and through the other of said slots without requiring that the portion of said back panel member extending between said slots be outwardly displaced from the remainder of said back panel member and said unitary member to provide space for the portion of said strap extending between said slots.

* * * * *